United States Patent [19]

Jones

[11] 3,956,159

[45] May 11, 1976

[54] STABLE CONCENTRATED LIQUID PEROXYGEN BLEACH COMPOSITION

[75] Inventor: John Paul Jones, Cincinnati, Ohio

[73] Assignee: The Procter & Gamble Company, Cincinnati, Ohio

[22] Filed: Nov. 25, 1974

[21] Appl. No.: 526,751

[52] U.S. Cl. ..... 252/104; 252/99; 252/100; 252/102; 252/103; 252/186

[51] Int. Cl.[2] ..... C11D 7/50; C11D 7/56

[58] Field of Search ..... 252/104, 186, 100, 102, 252/103, 99

[56] References Cited

UNITED STATES PATENTS

| | | | |
|---|---|---|---|
| 3,130,169 | 4/1964 | Blumbergs et al. | 252/104 X |
| 3,248,336 | 4/1966 | Blumbergs | 252/104 X |
| 3,839,216 | 10/1974 | Schreyer et al. | 252/104 X |

*Primary Examiner*—Mayer Weinblatt

*Attorney, Agent, or Firm*—Charles R. Wilson; Jerry J. Yetter; Richard C. Witte

[57] ABSTRACT

A shelf-stable concentrated liquid organic peroxyacid bleach composition comprising a peroxyacid, a ternary solvent system, a stabilizing agent and, preferably, a buffering agent.

4 Claims, No Drawings

STABLE CONCENTRATED LIQUID PEROXYGEN BLEACH COMPOSITION

BACKGROUND OF THE INVENTION

This invention relates to a peroxyacid bleach composition in liquid form which is stable to decomposition of the peroxyacid compound during extended storage.

It is convenient and desirable to provide bleach compositions in liquid form. Peroxyacids, as a class, are desirable bleaches inasmuch as they do not weaken or react with dyed fabrics in the manner of harsh chlorine bleaches. However, most peroxyacids are solids, and it is very difficult to prepare stable liquid compositions containing peroxyacids as the active bleaching component. This difficulty is due in part to the inherently unstable nature of peroxyacids, which decompose at a rather rapid rate when placed in an aqueous medium or in a solution containing other materials in combination with the highly reactive peroxyacid compounds.

It is well-known that the tendency of peroxyacid compounds to decompose depends on such factors as temperature, pH, the presence or absence of water and the organic compounds which may come in contact with them. Moreover, contact with metal ions speeds decomposition. Small amounts of heavy metals catalytically cause liquid peroxyacid bleaches to decompose during storage and are therefore highly undesirable. Yet, the bleaching and cleansing action of peroxyacids is based on their ready decomposition, which yields minute bubbles of oxygen which penetrate cleanse and bleach materials such as textiles and clothing in an aqueous solution. However, the reactive nature of peroxyacids, which is so desirable in the cleansing and bleaching of fabrics during a laundering operation, presents special problems to the formulator upon storage of the bleach in liquid media.

Several methods have been utilized in the past to stabilize peroxyacid type compounds. For example, U.S. Pat. No. 3,192,254, Hayes, STABILIZATION OF PERACIDS WITH PICOLINIC ACID, issued June 29, 1965, relates to the stabilization of peracetic acid contained in a non-reactive organic solvent by means of picolinic and dipicolinic acids.

Another method of stabilizing peroxygen compounds is set forth in U.S. Pat. No. 3,192,255, Cann, STABILIZATION OF PERACETIC ACID WITH QUINALDIC ACID, issued June 29, 1965, which discloses a stabilized organic peroxide composition consisting of peracetic acid, an organic solvent and quinaldic acid.

U.S. Pat. No. 3,130,169, Blumbergs et al., STABILIZATION OF PEROXYCARBOXYLIC ACIDS, issued Apr. 21, 1964, teaches a process for stabilizing peroxycarboxylic acids which utilizes a solvent system composed of up to 80% of an organic saturated tertiary alcohol or mixture of tertiary alcohols. A preferred solvent system consists of tertiary butyl alcohol, either alone or in combination with tertiary amyl alcohol. Dipicolinic acid is additionally taught for use therein to complex heavy metal ions.

U.S. Pat. No. 3,661,789, Carey et al., STABILIZED OXYGEN BLEACH-ACTIVATOR SYSTEM, issued May 9, 1972, relates to an oxygen releasing bleach system which is said to be storage-stable. The reference discloses perborate bleaches, and bleach activators such as the heavy metal salts of transition metals, in combination with chelating agents such as picolinic acid and nonionic surfactants or glycols.

U.S. Pat. No. 3,388,069, Linder et al., LIQUID ACTIVE OXYGEN DETERGENT BLEACHING CONCENTRATE, issued June 11, 1968, relates to stabilized peroxygen compounds, hydrogen peroxide, and surfactant stabilizers.

U.S. Pat. No. 2,454,254, Knoch et al., STABILIZED ORGANIC PEROXIDES, issued Feb. 24, 1944, discloses esters of phthalic acid for stabilizing peroxides.

As can be seen from the foregoing, there is a continuing search for methods of preparing stable, liquid peroxyacid bleaches. It has now been discovered that by combining certain alcohols and certain acetate compounds in a ternary solvent system with a peroxyacid compound, a stabilizing agent and, optionally, a buffering agent, improved, stable bleaching compositions especially adapted to bleaching clothes during a laundering or rinsing operation are provided.

Accordingly, it is a primary object of the present invention to provide organic solvent/peroxyacid bleach compositions which are stable to decomposition on prolonged storage.

It is another object of the present invention to provide storage-stable concentrated peroxyacid bleaching compositions for use alone or in conjunction with other conventional cleaning compositions to enhance the cleansing of fabrics and clothing.

These and other objects are obtained herein as will be seen from the following disclosure.

SUMMARY OF THE INVENTION

This invention provides an improved stabilized concentrated liquid peroxyacid bleach composition, comprising:

a. from about 94% to about 98% by weight of an anhydrous ternary solvent mixture consisting essentially of:
   i. from about 20% to about 45% by weight of t-butyl alcohol;
   ii. from about 20% to about 40% by weight of ethylene diacetate;
   iii. from about 20% to about 40% by weight of glycerol triacetate;
b. from about 1% to about 6% by weight of a peroxyacid;
c. from about 0.005% to about 0.05% by weight of a stabilizing agent selected from picolinic acid, dipicolinic acid, or quinaldic acid; and
d. from 0% to about 3% by weight of a pH 6.5 to pH 12 buffering agent.

DETAILED DESCRIPTION OF THE INVENTION

By the present invention a liquid composition is provided which stabilizes peroxyacid bleaches against decomposition during long storage without substantial loss of the available oxygen content of the bleach. The components are described, in turn, below.

The bleaching compositions herein comprise, as an essential ingredient, a liquid ternary solvent system comprising from about 20% to about 45% (wt.) of tertiary butyl (t-butyl) alcohol, and preferably containing 25% to 35% of the t-butyl alcohol as one component of the liquid carrier. The ternary solvent herein also contains from 20% to 40% (wt.) of ethylenediacetate, and preferably contains from 20% to 35% (wt.) of this component. The solvent system also contains from 20% to 40% (wt.) of glycerol triacetate, and preferably contains from 20% to 35% (wt.) of this component. The solvent system must be substantially anhydrous, inasmuch as water enhances decomposition of the peroxyacids herein.

The particular ternary solvent system used herein offers the advantage of being a pourable liquid and a good solvent for the various essential components of the instant bleaching compositions. Since the decomposition of peroxyacid bleaches is a complex reaction, and depends on so many rate determining variables, the exact mode whereby the ternary solvent system helps stabilize these acids is not known. Whatever the reason, it has been discovered that the above defined compounds exhibit synergistic stabilizing effects when a peroxyacid is dissolved therein. Moreover, the ternary solvent is miscible with water and is easily and homogeneously admixed with aqueous laundering media. Finally, the components of the solvent are toxicologically acceptable under common use conditions and do not affect fabrics.

The bleaches used in the present invention are the organic peroxyacids, and the water-soluble salts thereof. The salts should not be those of transition metals, since, when dissolved, these metals catalyze decomposition of the peroxyacids. The alkali and ammonium salts are highly preferred herein, as are the free acid forms of the peroxyacids.

Peroxyacids which are used herein are of the general formula

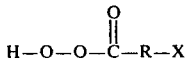

wherein R is an alkylene group containing from 1 to about 12 carbon atoms, and X can be, for example, methyl, chloromethyl, carboxyl, sulfonate or peroxycarboxylate. Noninterfering substituents, such as the halogens, can be contained in the alkylene linkage or X group without detrimental effects.

Examples of preferred peroxyacids include diperazelaic acid, perazelaic acid, and diperadipic acid. Perazelaic acid ($R = C_7H_{14}$; $X = COOH$) is the preferred peroxyacid for use herein.

The peroxyacid bleaching agents are present in the instant compositions at levels of from about 1% to 6% by weight. Concentrations of 3% to 5% are preferred for most purposes. It should be understood that the concentration range for the peroxyacid of the present bleaching compositions depends to a large extent on the particular use or utility for which a given composition is formulated, and higher or lower levels within the range can be selected according to the desires of the formulator.

The peroxyacid bleaches are used in the above-described ternary solvent system conjointly with a stabilizing agent. The stabilizing agents used herein can be dissolved in the ternary solvent system prior to the addition of the peroxyacid, or mixed with the peroxyacid and conjointly added to said solvent system. In any event, it is preferred to incorporate the stabilizing agent into the bleach composition either prior to or conjointly with the addition of the peroxyacid. The primary function of the stabilizing agent is to chelate and effectively remove any free metal ions which can catalyze the decomposition of the peroxyacids. Chelation of the metal ions renders them unavailable as catalysts by incorporating them in the complex metallo-organic chelate structure.

Of course, the stabilizing agents which are suitable for use herein are those which will complex with heavy metal ions without adversely affecting the bleach composition. However, not all chelators are useful stabilizers herein. For example, some chelators are not soluble in the ternary solvent systems and are thus unavailable to scavenge vagrant heavy metal ions. Some chelators, themselves, can react with the peroxyacids, or will release the metal ions in their presence. It has now been found that picolinic acid, dipicolinic acid, and quinaldic acid, and the organic solvent-soluble salts thereof, are useful stabilizers herein.

The concentration of stabilizing agent in the bleach composition depends on such variables as the concentration of metal ions present. For most purposes, and assuming no unusually high metal ion contamination, the stabilizing agent is used in the instant compositions at levels from 0.005% to 0.05%, especially from 0.01% to 0.02%, by weight.

The compositions herein provide optimal bleaching performance at a solution pH of from 6.5 to about 12. Outside this range, bleaching performance falls off markedly. Since peracids or the persalts used in the present invention are generally acidic, it is preferred to maintain the optimal pH conditions by utilization of standard buffering agents. Any non-interfering compound which can alter or maintain a pH within the desired range is suitable for use herein. For example, phosphates, carbonates, or bicarbonates which buffer within the pH range of 6.5 to 12, preferably 7 to 10, can be utilized. Examples of suitable buffering agents include sodium bicarbonate, sodium carbonate, disodium hydrogen phosphate and sodium dihydrogen phosphate. The buffering agents of the present invention usually comprise from about 0% to 3% by weight of the bleach composition.

The liquid concentrated bleach compositions of the present invention are further illustrated by the following examples, which in no way should be construed as limitations thereof, but are preferred embodiments to help enable an artisan to practice the invention.

EXAMPLE I

A liquid concentrated bleaching composition was prepared by mixing 20 ml of t-butyl alcohol with 10 ml of ethylenediacetate and 10 ml of glycerol triacetate. To this ternary solvent system was added 0.004 gm of dipicolinic acid. The mixture was stirred at 26°C for a few minutes, then 2.25 gms of diperazelaic acid was added with continued stirring of the solution. The solution was stored in a glass bottle closed with a plastic cap at room temperature.

At various time intervals, samples of the above bleach compositions were titrated to determine its active oxygen content. The titration was conducted as follows: about 2 grams of the bleach composition were added to 15 ml of a 2:1 ratio mixture of water and glacial acetic acid. Immediately before titration, 5.00 ml of 10% potassium iodide (KI) were added and the solution titrated to a starch end-point (e.g., a few drops of 0.5% starch were added to the solution) utilizing 0.01N sodium thiosulfate ($Na_2S_2O_3$) as the titrant. The amount of standarized sodium thiosulfate needed to titrate the bleach composition was used in conjunction with the amount of bleach solution used to determine the amount of active oxygen present.

Bleach stability over an extended period of time for the composition of Example I is indicated by the following data:

TABLE I

| Time (Days after Preparation) | Active Oxygen Content |
|---|---|
| 8 | 5.35% |
| 15 | 5.21% |
| 29 | 5.15% |
| 50 | 4.79% |
| 382 | 2.24% |

EXAMPLE II

A shelf stable bleach composition is formulated by mixing 10 ml of t-butyl alcohol with 10 ml of ethylenediacetate and 10 ml of glycerol triacetate. To this solvent solution is added 1.25 gms of perazelaic acid, 0.004 gm of picolinic acid, and sufficient sodium bicarbonate (ca. 1.0 gm) to maintain pH within the range of from 6.5 to 12. The bleaching solution retains a substantial active oxygen content over extended storage periods.

Quinaldic acid is substituted for the picolinic acid in the above composition with substantially the same results.

What is claimed is:

1. A storage stabilized concentrated liquid peroxyacid bleach composition, consisting essentially of:

a. from about 94% to about 98% by weight of an anhydrous ternary solvent mixture consisting essentially of:

i. from 20% to 45% by weight of t-butyl alcohol;

ii. from 20% to 40% by weight of ethylene diacetate;

iii. from 20% to 40% by weight of glycerol triacetate;

b. from about 1% to about 6% by weight of a peroxyacid having the formula

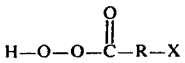

wherein R is an alkylene group containing from 1 to about 12 carbon atoms and X is methyl, chloromethyl, carboxyl, sulfonate or peroxycarboxylate and the water-soluble salts thereof;

c. from 0.005% to 0.05% by weight of a stabilizing agent selected from the group consisting of picolinic acid, dipicolinic acid, and quinaldic acid; and d. from 0% to 3% by weight of a pH 6.5 to pH 12 buffering agent selected from the group consisting of phosphates, carbonates and bicarbonates.

2. The composition of claim 1 wherein the peroxyacid is selected from the group consisting of diperazelaic acid, perazelaic acid and diperadipic acid.

3. The composition of claim 1 wherein the buffering agent is selected from the group consisting of sodium bicarbonate, sodium carbonate, disodium hydrogen phosphate and sodium dihydrogen phosphate.

4. The composition of claim 3 having a pH within the range of from about 7 to 10.

* * * * *